US005433448A

United States Patent [19]

Raphael et al.

[11] Patent Number: 5,433,448

[45] Date of Patent: Jul. 18, 1995

[54] THREE-DIMENSIONAL TIC-TAC-TOE GAME

[76] Inventors: Stewart C. Raphael; Audrey S. Raphael, both of 172-35 Highland Ave., Ste, 3F, Jamaica Estates, N.Y. 11432-2861; Richard R. King, 220 E. 7th St., Plainfield, N.J. 07060

[21] Appl. No.: 361,544

[22] Filed: Dec. 22, 1994

[51] Int. Cl.[6] ..... A63F 3/00

[52] U.S. Cl. ..... 273/241; 273/271; 273/DIG. 30

[58] Field of Search ..... 273/241, 271

[56] References Cited

U.S. PATENT DOCUMENTS

| | | | |
|---|---|---|---|
| 3,879,040 | 4/1975 | Smith | 273/241 |
| 3,930,651 | 1/1976 | Radar | 273/241 |
| 4,671,514 | 6/1987 | Wilson-Diehl | 273/287 |

FOREIGN PATENT DOCUMENTS

| | | | |
|---|---|---|---|
| 2198359 | 6/1988 | United Kingdom | 273/241 |

*Primary Examiner*—Benjamin H. Layno
*Attorney, Agent, or Firm*—Watson, Cole, Grindle & Watson

[57] ABSTRACT

A three-dimensional tic-tac-toe game which includes a lattice having cubicles for receiving X or O mating pieces therein. The pieces are held in the cubicles by Velcro patches on the pieces that cooperate with mating patches in the cubicles.

9 Claims, 1 Drawing Sheet

THREE-DIMENSIONAL TIC-TAC-TOE GAME

Figure 1:
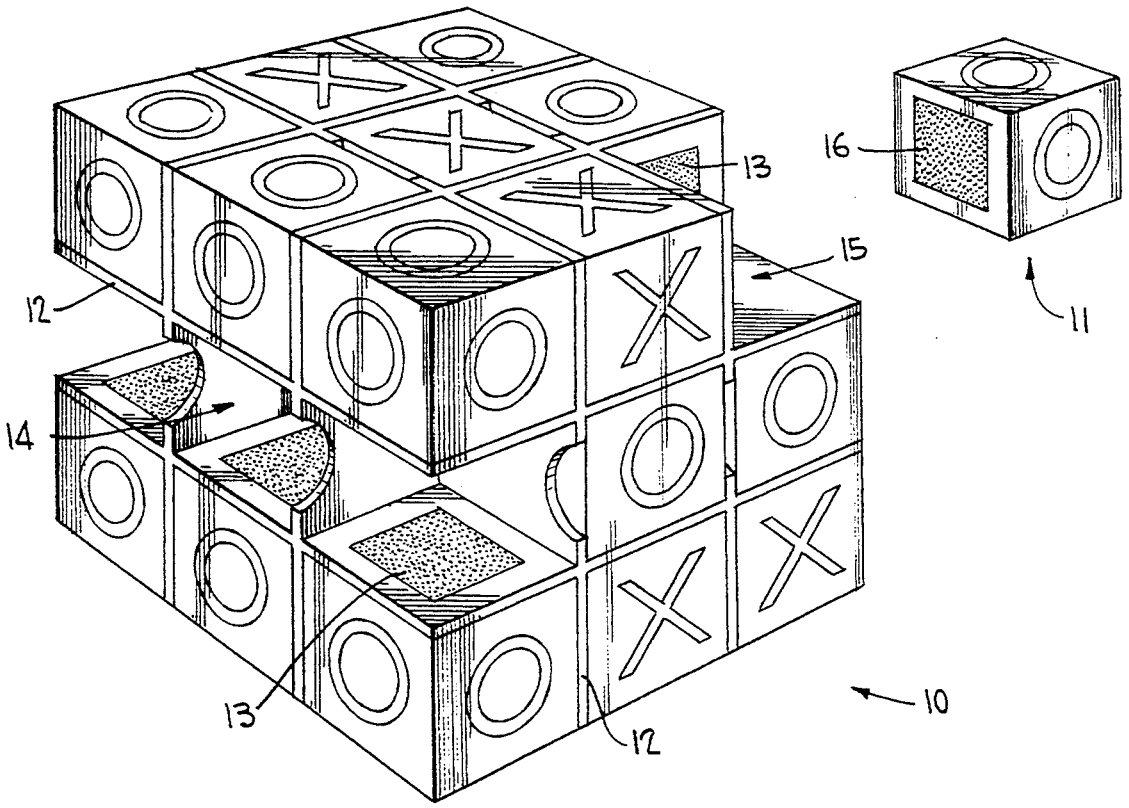

The present invention relates broadly to three-dimensional games in which pieces are inserted successively by two or more players and the object of which is to complete a desired pattern on more than a single surface of the game. More specifically, the present invention relates to a three-dimensional tic-tac-toe game.

BACKGROUND OF THE INVENTION

There are previous three-dimensional tic-tac-toe games. For example, such a game is described in U.S. Pat. No. 3,747,931, in which a cubic grid structure is provided with 26 playmaking compartments all of which are accessible from a plurality of sides of the cube. Balls are placed within the compartments and, since the balls are mobile and would roll from their assigned positions upon manipulation of the cube, transparent covers must be provided for each side of the cube so that after a ball is placed in an assigned position on the grid structure, the snap-on cover will be put in place to prevent the ball from falling from its position in the grid structure. Moreover, games such as that disclosed in U.S. Pat. No. 3,747,931 are described as being played on one side of the grid only until the completion of the game on that side. Then a cover is supplied over the completed side of the cube, whereafter the players may proceed to another side of the grid and play that side.

The need to utilize a cover to retain balls or other game markers, and to complete one side of the grid before proceeding to other sides, greatly detracts from the pleasure of playing a tic-tac-toe game. To those who are cognizant of the game and play it with some degree of regularity, it quickly becomes apparent that he who makes the first play in the nine-box portion of the game cannot be the loser unless he misplays. It also rapidly becomes apparent that, absent error by the initial player, the second player of the game cannot be the winner and, at best, can only proceed to a draw. Thus, the novelty of the game is quickly exhausted when the game is played in two-dimensional form. Playing the game in a three-dimensional form, as is disclosed in the '931 patent referred to, simply presents six repetitive two-dimensional games which, if played properly on both sides, only results in six draws. Thus, the players of tic-tac-toe games rapidly lose their enthusiasm for the game.

The present invention, on the other hand, permits playing on all six sides of a cubic grid simultaneously, and without the need for utilization of covers for any side of the game. Playing all sides simultaneously greatly adds to the excitement of playing tic-tac-toe and, indeed, makes tic-tac-toe a completely different game, rather than mere repetitive placement of X's and O's. It is perfectly possible for a player to sacrifice games on one or two of the sides of the cube, yet in so doing achieve such superior positions on the other sides as will allow him to win more sides of the cube than he loses and, therefore, achieve total victory in playing the entirety of the cube.

It is, therefore, a primary object of the present invention to transform what has become almost a mechanistic application of X's and O's in a two-dimensional tic-tac-toe game into a three-dimensional game that is far from mechanical and provides a new and stimulated interest in tic-tac-toe games.

Another objective of the present invention is to provide a three-dimensional tic-tac-toe device which permits players to pass the cube about freely and rotate it during the course of play.

It is still another object of our invention to provide a three-dimensional tic-tac-toe game in which play can be made on all six surfaces of the lattice structure in successive moves.

SUMMARY OF THE INVENTION

The present invention is, as stated, directed to a three-dimensional tic-tac-toe game. It comprises a lattice having a plurality of faces each of which is divided by partitions into nine cubicles. The cubicles are bounded by at least three interior surfaces formed by the partitions, and each cubicle is dimensioned to receive a mating piece therein.

An important part of the invention is that there is holding means formed on at least one of the interior surfaces of each cubicle. So, a plurality of cubicle mating pieces are provided, and each of those mating pieces has a multiplicity of surfaces on at least one of which there is holding means for cooperating with the holding means on an interior surface of the cubicle. Each mating piece also has X's or O's, or some other design that is to be matched in play of the game, on at least one piece surface that does not contain holding means.

As a consequence, when players of the game alternately position X and O mating pieces in the cubicles, they do so so that the holding means on the piece is brought into contact with the holding means on an interior surface of the cubicle in such a manner that the holding means cooperate to hold the mating piece in the cubicle of the game lattice. There it will remain until intentionally dislodged.

In more specific embodiments, my invention comprises a lattice in the form of a cube, and the mating pieces are also cubic in form. Preferably, there is holding means on one cubicle surface and one mating piece surface, and on the other five surfaces of a mating piece cube there are all either X's or O's. In this manner, when the holding means on both a mating piece and cubicle surface cooperate, the player's symbol will be displayed on every other surface of the mating piece that is exterior of the lattice.

In the most preferred mode of my invention, the holding means is formed from male of female type of fabric that is adapted to be fastened to fabric of the other type, but can readily be separated therefrom. Such fabric is often made of nylon and has been extensively marketed under the trademark Velcro. Thus, there may be male Velcro on the cubicle surface, and female Velcro on the mating piece, or vice-versa. In this manner the lattice may be freely handled no matter how many mating pieces have been inserted in cubicles of the lattice.

These and other objects, features and advantages of the present invention will become more apparent when viewed in connection with a preferred embodiment of our invention, which is illustrated in the accompanying drawing in which FIG. 1, the sole FIGURE, is a perspective view of a lattice and mating piece of the present invention, the former being only partially filled to reveal interior structure.

Shown in FIG. 1 is what is presently considered to be the best mode of our invention. There illustrated is a lattice structure indicated generally by reference numeral 10, which is filled with mating pieces 11 except for four spaces that can be seen in the lattice where those mating pieces have not been put in place. The lattice 10 is generally in the form of a cube with six faces, each of which has been subdivided by partitions such as those indicated by numeral 12, to form nine cubicles 14 on each face of the lattice. When unfilled with mating pieces, the lattice structure is entirely open as subdivided by partitions 12. Thus, each lattice 10 has a total of 26 cubicles or compartments, each of which is accessible to placement of a mating piece 11 therewithin.

With regard to the means in the lattice structure 10 by which a mating piece may be held in position on the structure without the need for any separate retaining means, such as a snap-on cover, each of the 26 compartments has a rectangular patch 13 which is most preferably formed from a nylon fabric of male or female types marketed under the trademark Velcro. As shown, Velcro patches 13 are substantially rectangular in form, although it will be apparent that a rectangular form is not an absolute requirement.

Each compartment or cubicle 14 of the lattice 10 has at least three surfaces designed to mate with a mating piece 11. That mating piece has a rectangular Velcro patch 16 which is adapted to mate with and to be held by the Velcro patch 13 on the compartment wall. In the most preferred present embodiment of our invention, each of the other five sides of each mating piece 11, which is cubic in form, will contain either an X or an O, according to which player plays the X or O cubes. In this manner, were mating piece. 11 inserted in the end compartment, indicated generally by arrow 15, that would be done by placing patch 16 against patch 13, in which case the mating piece 11 would fill the entirety of cubicle 14. As so positioned, each of the other surfaces of mating piece 11 would have an O on it, and although two of those surfaces would be hidden by being juxtaposed against partitions 12, the other three surfaces that carry the letter 0 would be exposed to view. In this manner the O player would be achieving placement of his symbol simultaneously on three different scoring surfaces of the cube 10.

With respect to the actual play of the game, two players alternately place a single O or X cube in the lattice structure, with any player who completes a series of three O's or three X's in a row scoring a fixed number of points. As will be apparent from the description of the illustrated embodiment, placement of a mating piece 11 in a corner compartment 15 will simultaneously place the symbol carried by that piece on three different surfaces, whereas placing that same piece 11 in an interior location rather than in an end slot will result in that symbol simultaneously appearing on only two, or with a central cubicle, only one surface of the cube. As a consequence, various strategies will develop enabling players to score as many points as possible by completing as many rows of consecutive symbols as they can. The game may be structured so that scoring can be accomplished in a variety of ways, e.g., an interior sequence of symbols could count more than an exterior sequence. Also, in an advanced version of the game, all surfaces of the mating pieces other than the surface that carries a Velcro patch 14 need not carry the same symbol: some surfaces could carry no symbol, and other surfaces might carry the symbol of the opposing player. Various versions for playing the game are almost endless.

It will be apparent, then, that while we have described our invention with specific respect to a preferred embodiment thereof, many variants of that preferred embodiment will become apparent to those of skill in the art. As to all such variations, we desire that they be included with the purview of the invention, which is to be limited only by the scope, including equivalents, of the following, appended claims.

What is claimed is:

1. A three-dimensional tic-tac-toe game, comprising:

a lattice having a plurality of faces each of which is divided by partitions into nine cubicles, each of said cubicles being bounded by at least three interior surfaces formed by said partitions and dimensioned to receive a mating piece therein, holding means formed on at least one of said interior surfaces of said cubicles, and a plurality of mating pieces having a multiplicity of surfaces, each of said pieces carrying on at least one of its surfaces holding means for cooperating with said holding means on one of said interior surfaces of said cubicles, and at least one other surface of each said mating pieces carrying an X or an O that is displayed outwardly when said holding means on said mating piece is disposed in cooperating position with said holding means on said cubicle surface, so that when players of said game alternately position X an O pieces in said cubicles, said pieces will remain in said cubicles despite normal play movements of said game lattice.

2. A three-dimensional tic-tac-toe game as claimed in claim 1, in which said lattice is in the form of a cube having six faces.

3. A three-dimensional tic-tac-toe game as claimed in claim 2, in which said mating pieces are in the form of cubes.

4. A three-dimensional tic-tac-toe game as claimed in claim 1, in which each of said mating pieces carries means on one of its surfaces for cooperating with said holding means on one of said interior surfaces of said cubicles, and on all of its other surfaces carries an X or an O.

5. A three-dimensional tic-tac-toe game as claimed in claim 1, in which said cubicle surface holding means is formed on only one of said interior surfaces of each of said cubicles, and said mating piece holding means is formed on only one of said surfaces of each of said mating pieces.

6. A three-dimensional tic-tac-toe game, comprising a lattice having a plurality of faces each of which is divided by partitions into nine cubicles, each of said cubicles being bounded by at least three interior surfaces formed by said partitions and dimensioned to receive a mating piece therein, and a swatch of fabric adhered to at least one of said interior surfaces of each of said cubicles, said fabric being capable of releasably holding to another fabric swatch, and a plurality of mating pieces having a multiplicity of surfaces, each of said pieces carrying on at least one of said surfaces a swatch of fabric for cooperating with said fabric swatch on said interior surface of said cubicles, said other surfaces of said mating pieces carrying an X or an O that is displayed outwardly when said fabric swatch on said mating pieces is disposed in adhering, cooperating position with said fabric swatch means on said cubicle surface, so that when players of said game alternately position X and O pieces in said cubicles, said pieces will remain in said cubicle despite normal play movements of said game lattice.

7. A three-dimensional tic-tac-toe game as claimed in claim 6, in which said fabric are swatches formed from male and female Velcro fabric.

8. A three-dimensional tic-tac-toe game as claimed in claim 7, in which all of said other surfaces of said mating pieces that do not carry a fabric swatch carry either an X or an O.

9. A three-dimensional tic-tac-toe game, comprising;

a cubic lattice having six faces each of which is divided by partitions into nine cubicles, each of said cubicles being bounded by at least three interior surfaces formed by said partitions and dimensioned to receive a cubic mating piece therein, holding means formed on one of said interior surfaces of each of said cubicles, said holding means comprising either male or female Velcro fabric, and a plurality of mating pieces in the form of cubes having six surfaces, each of said pieces carrying on one of its surfaces male or female Velcro fabric for cooperating with said Velcro fabric on said one interior surface of said cubicles and the other surfaces of each of said mating pieces carrying an X or an O, so that when players of said game alternately position X and O pieces in said cubicles, said pieces will remain in said cubicles despite normal play movements of said game lattice.

* * * * *